United States Patent [19]

Kunze

[11] 3,974,415

[45] Aug. 10, 1976

[54] LIGHT-SENSITIVE TARGET

[75] Inventor: Claus Kunze, Taunusstein, Germany

[73] Assignee: Heimann GmbH, Germany

[22] Filed: May 13, 1974

[21] Appl. No.: 469,115

[30] Foreign Application Priority Data

May 15, 1973 Germany ..... 2324497

[52] U.S. Cl. ..... 313/371; 313/386

[51] Int. Cl.[2] ..... H01J 31/46; H01J 29/36; H01J 31/68

[58] Field of Search ..... 313/384, 371, 386, 385, 313/388, 389, 390, 474, 365, 373, 376; 178/7.86

[56] References Cited

UNITED STATES PATENTS

| | | | |
|---|---|---|---|
| 2,770,746 | 11/1956 | Gray | 313/371 |
| 2,813,989 | 11/1957 | Weimer | 313/371 |
| 2,898,489 | 8/1959 | Weimer | 313/371 |
| 3,772,552 | 11/1973 | Kobota | 313/371 |

*Primary Examiner*—Robert Segal

*Attorney, Agent, or Firm*—Hill, Gross, Simpson, Van Santen, Steadman, Chiara & Simpson

[57] ABSTRACT

A light-sensitive target for a color television system which includes a transparent carrier plate such as the front plate of a color television camera, having discrete strips of interference filter material disposed thereon. The strips are disposed in parallel relation on the inside surface of the transparent carrier. An intermediate layer is formed over these strips to eliminate abrupt or sharp edges presented by the strip to the inside surface of the tube. A conductive layer is formed over the intermediate layer and finally a light sensitive medium is disposed over the entire inside surface of the system. By means of the intermediate layer, the contour between the light-sensitive and the conductive layers are caused to have generally rounded configurations, thereby eliminating interferences.

6 Claims, 2 Drawing Figures

LIGHT-SENSITIVE TARGET

BACKGROUND OF THE INVENTION

1. Description of the Prior Art

Prior light sensitive target arrangements have utilized interference strip filters with sharp edges. When the conductive electrodes in the light sensitive medium are disposed over the surface of the strip filters, interference results due to the intense electric fields which are developed at the abrupt edges of the various layers. The present invention utilizes an intermediate layer which rounds the abrupt edges and presents a generally smooth contour to the conductive and light sensitive layers, thereby eliminating any possible interference due to the concentration of electric fields at sharp edges of the target.

2. Field of the Invention

The field of art to which this invention pertains is light sensitive targets and, in particular, to light sensitive targets using interference strip filters having relatively sharp edges and which have conductive electrodes and light sensitive layers formed over the surface of the filters.

SUMMARY OF THE INVENTION

An important feature of the present invention is to provide an improved light sensitive target.

Another feature of the present invention is to provide a light sensitive target utilizing discrete interference strip filters having relatively sharp or abrupt edges.

It is a principal object of the present invention to provide a light sensitive target utilizing discrete strip filters having abrupt edges which eliminates interference due to high field concentration at the sharp edges.

It is another object of the present invention to provide a light sensitive target as described above wherein an intermediate layer is formed over the discrete strip filters to round the sharp edges thereof for the purpose of eliminating such interference.

It is another object of the present invention to provide an intermediate layer as described above which is formed of a lacquer material and which provides a transition from the sharp or abrupt edges of the strip filters to the smooth and rounded surfaces of a conductive electrode and a light sensitive layer.

It is another object of the present invention to provide an intermediate layer which comprises a silicon compound.

These and other objects, features and advantages of the present invention will be understood in greater detail from the following description and the associated drawings wherein reference numerals are utilized to designate a preferred embodiment.

DESCRIPTION OF THE PREFERRED EMBODIMENT

The present invention relates to a light sensitive, semi-conductor target arranged on a transparent carrier such as a front glass plate of a color television camera. There is provided an electrically conductive transparent layer on the carrier plate which serves as a signal electrode, and a light sensitive semi-conductor layer is arranged to overlie the conductive transparent layer. The present invention has particular significance in the construction of a light transmissive front glass plate for a television camera tube of the vidicon type and is particularly important when the front glass plate possesses a surface which has sharp edges. Sharp edges can be, for instance, locating marks etched or engraved into the front glass plate or also edges developed during the vapor deposition of raised surfaces and, in particular, the raised edges of interference strip filters.

Since there is fundamentally no difference in the effects of a vapor deposited layer or an etched or engraved structure, the aim of this invention is essentially to eliminate the difficulties associated with the direct application of the strip filters to the carrier plate and the overlying transparent electrically conductive layer which serves as the signal electrode.

Color strip filters, for instance, vapor deposited interference strips, may be arranged in a regular pattern on the inside surface of the front glass plate of a camera tube. The thickness of the strips may be a few micrometers ($\mu$m). The strips may be produced by means of a current photo-etching process. Normally, the conducted transparent electrode is applied directly on the surface of these strips. This layer may be formed of $SnO_2$. A light sensitive semiconductor layer is then caused to overlie the electrode layer. This semiconductor layer may be formed of $Sb_2S_3$.

The feature of the light sensitive target described herein is that the sharp edges which may be present on the glass carrier are eliminated by means of an intermediate layer which is formed on the surface of such sharp edges. This presents a rounded surface to the layers later deposited thereon and eliminates any high intensity fields which may otherwise be produced by those sharp edges. The intermediate layer may be formed of a vacuum resistant lacquer layer and then the preferred embodiment can be advantageously formed of a silicon compound.

Figure 1:
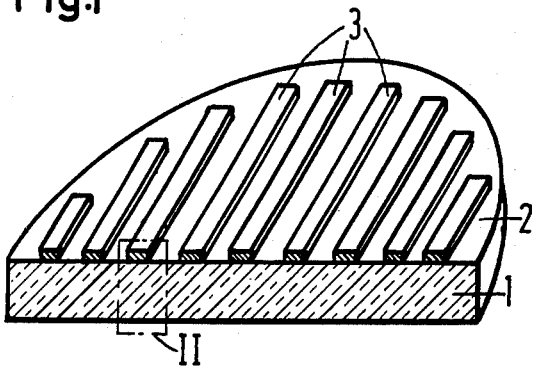
FIG. 1 shows a portion of a light sensitive target which comprises a glass carrier with interference strip filters disposed thereon.

Referring to the drawings in greater detail, FIG. 1 shows a perspective partial view of a carrier glass plate having the interference strip filter arranged thereon in the production stage. The carrier plate itself is identified by the numeral 1 and is, in this case, the front glass plate of a camera tube such as is used in a single tube color television camera. On the surface 2 of the carrier glass plate, which faces the inside of the camera tube, a plurality of filter strips 3 of a few $\mu$m in thickness are arranged in a generally parallel relation to one another. These strips may be produced by vacuum deposition, followed by a photo-etching process. The result is that the strips have relatively sharp edges along the length thereon which can produce problems in the use of the color television camera.

In a known manner, it is necessary to apply a conductive light transmissive electrode to the surface of the front plate and then a light sensitive semiconductor layer must be applied over the surface of the electrode.

During the operation of the camera, it is often the case that a high intensity electric field develops between the light sensitive layer and the electrically conductive layer. This high intensity field is a maximum at the sharp edges of the filter strips. This then gives rise to an interference in the use of the camera. In particular, it leads to an increased dark current.

Figure 2:
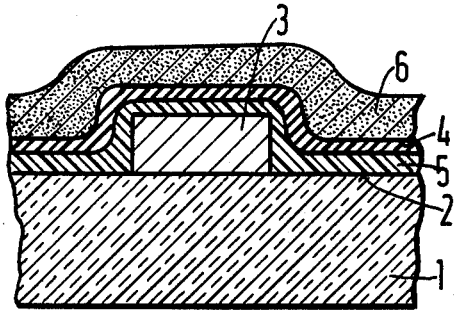
FIG. 2 shows a portion of the carrier of FIG. 1, having an intermediate layer, a conductant electrode and a light sensitive layer formed over the interference strip filters, according to the present invention.

This disadvantage is avoided by the present invention by the arrangement shown in FIG. 2. In FIG. 2 an intermediate layer 5 is disposed between the interference strip filter 3 and the conductive electrode 4. In this way the sharp edges formed by the interference strip filter, as are plainly evidenced in FIG. 2, are rounded by the intermediate layer. Therefore when the conductive electrode is applied to the glass plate, it follows the smooth contour of the intermediate layer rather than the abrupt contour provided by the etching of the interference filter. This eliminates interference effects between the light sensitive layer 6 and the underlying electrically conductive base 4.

The invention described herein is not limited to the use of the particular arrangement shown in a color television camera. However, it may be used in any arrangement utilizing semiconductor layers where sharp or abrupt edges result in the development of high electric fields which result in interference in the use of the light sensitive target.

I claim as my invention:

1. A light-sensitive system for a color television camera tube comprising:

a transparent carrier plate for supporting the system, color strip filters arranged in substantially parallel relation on the inside surface of said transparent carrier plate, said strip filters having relatively sharp longitudinal edges, a transparent intermediate layer formed over said strip filters to present relatively rounded edges at the exterior thereof, a transparent conductive layer overlying said transparent intermediate layer, and a light sensitive layer overlying said conductive layer, whereby sharp edges are eliminated between the conductive layer and the light sensitive layer.

2. A light sensitive system in accordance with claim 1 wherein said transparent intermediate layer comprises a vaccum resistant lacquer layer.

3. A light sensitive target in accordance with claim 2 wherein said transparent intermediate layer comprises a silicon compound.

4. A light sensitive target comprising:

a transparent carrier including a first surface having relatively abrupt edges, a transparent intermediate layer covering the abrupt edges of said surface to present a second surface having only relatively rounded edges, a transparent conductive layer interposed between said transparent intermediate layer and a light sensitive median, said light sensitive median covering the transparent conductive layer and having its sectional contour influenced by the rounded edges of the intermediate layer.

5. A light sensitive target in accordance with claim 4 wherein the intermediate layer is a lacquer.

6. A light sensitive target in accordance with claim 5 wherein the intermediate layer is a silicon compound.

* * * * *